US006651370B1

(12) United States Patent
Sud

(10) Patent No.: US 6,651,370 B1
(45) Date of Patent: Nov. 25, 2003

(54) THREE-DIMENSIONAL DECORATION WITH RAISED IMAGE

(76) Inventor: Alexander M. Sud, 3704 Sudbury La., Louisville, KY (US) 40220

( * ) Notice: Subject to any disclaimer, the term of this patent is extended or adjusted under 35 U.S.C. 154(b) by 0 days.

(21) Appl. No.: 09/951,172

(22) Filed: Sep. 13, 2001

Related U.S. Application Data

(60) Provisional application No. 60/233,182, filed on Sep. 15, 2000.

(51) Int. Cl.[7] ..... A47G 1/06

(52) U.S. Cl. ..... 40/743; 40/738; 40/124.07

(58) Field of Search ..... 428/913.3, 14, 428/172; 40/738, 743, 781, 800, 124.191, 124.07

(56) References Cited

U.S. PATENT DOCUMENTS

| | | | | | |
|---|---|---|---|---|---|
| 861,822 | A | * | 7/1907 | Feher | 40/800 X |
| 2,183,426 | A | | 12/1939 | Hart | |
| 2,631,046 | A | | 3/1953 | Stephens | |
| 2,643,899 | A | * | 6/1953 | Cavalero | 40/800 X |
| 2,889,651 | A | | 6/1959 | Baldanza | |
| 2,946,137 | A | | 7/1960 | Worth et al. | |
| 3,057,097 | A | * | 10/1962 | Douglas | |
| 3,310,321 | A | | 3/1967 | Freund | |
| 3,321,860 | A | | 5/1967 | Dichtl et al. | |
| RE26,948 | E | * | 9/1970 | Klein | |
| 3,798,806 | A | | 3/1974 | Sanford | |
| 3,972,417 | A | | 8/1976 | Iten et al. | |
| 4,215,499 | A | | 8/1980 | Wilson | |
| 4,380,128 | A | | 4/1983 | Ichikawa | 40/124.09 |
| 4,477,243 | A | | 10/1984 | Wallsten | |
| 4,555,423 | A | * | 11/1985 | Sands | 428/913.3 X |
| 4,579,708 | A | | 4/1986 | Rosart | |
| 4,737,329 | A | | 4/1988 | Rakoczy | |
| 4,779,734 | A | | 10/1988 | Kydonieus | |
| 4,840,275 | A | | 6/1989 | Faiola et al. | 206/423 |
| 4,841,651 | A | | 6/1989 | Conner | |
| 4,951,404 | A | | 8/1990 | Lithwick | 229/92.8 X |
| 4,979,619 | A | | 12/1990 | Hager | |
| 5,001,853 | A | | 3/1991 | Odien | 40/312 |
| 5,119,574 | A | | 6/1992 | King | 40/537 |
| 5,181,745 | A | | 1/1993 | Jacobsen et al. | |
| 5,199,745 | A | | 4/1993 | Balsamo | |
| 5,201,548 | A | | 4/1993 | Lang et al. | 283/2 |
| 5,217,162 | A | | 6/1993 | Shibahara | 229/92.8 |
| 5,377,836 | A | | 1/1995 | Eisenbraun | |
| 5,379,886 | A | | 1/1995 | Brauner et al. | |
| 5,600,939 | A | | 2/1997 | Giovannone | |
| 5,879,028 | A | | 3/1999 | Benoit | |
| 6,106,023 | A | | 8/2000 | Sud et al. | 283/117 |

FOREIGN PATENT DOCUMENTS

| | | | | |
|---|---|---|---|---|
| CH | 19847 | * | 4/1900 | 40/160 |

* cited by examiner

*Primary Examiner*—Joanne Silbermann
(74) *Attorney, Agent, or Firm*—Camoriano and Associates; Theresa Fritz Camoriano

(57) ABSTRACT

A decoration includes a thin cover sheet onto which an image has been printed and which has been formed into a contoured shape at least partially corresponding to the image. A support layer, which preferably is thicker than the cover sheet, has a contour which substantially follows the contour of the cover sheet. The support member lies behind the cover sheet to provide structural support and may be formed with ribs for additional structural support. In a preferred embodiment, the cover sheet and the support are clamped between a frame and a backing member.

19 Claims, 5 Drawing Sheets

THREE-DIMENSIONAL DECORATION WITH RAISED IMAGE

This application claims priority from U.S. Provisional Application Ser. No. 60/233,182, filed on Sep. 15, 2000.

BACKGROUND OF THE INVENTION

Relief images are well-known and have been made of clay, wood, plastic and other materials. A typical relief image is either cast or carved, and, if it includes a variety of colors, they usually are painted on by hand. One way to make an attractive relief image is to run a relatively thin plastic material through a printing device to create a high quality printed image and then to vacuum form the material to give relief to the image. However, in order to run the material through a printer, it must be relatively thin. This results in a fairly lightweight, flexible product, which does not have the same aesthetic appeal as a more solid cast or carved image. As shown in my U.S. Pat. No. 6,106,023, which is hereby incorporated by reference, one way to protect the flexible image from being damaged is to provide a cover and a raised frame around the image. However, since the image is on a lightweight, flexible sheet, it can easily flex, and it does not have the same effect as a solid or cast piece. Similarly, as one picks up the image, the relative lack of weight gives away the fact that this is not a solid or cast piece. The more rigid the relief image is and the heavier it feels, the more it resembles a cast, carved, or solid piece, and the higher its perceived quality and value by the end user.

SUMMARY OF THE INVENTION

The present invention provides a plaque, wall hanging, or other decoration in which a thin, printed and formed member is supported by another formed member, thereby imparting structural strength. The reinforcing layer may have reinforcing ribs to provide additional structural rigidity. These two layers may be glued together, snap-fitted together, or assembled together in other known ways so that the front sheet is supported by the reinforcing layer. A third sheet of flat material may be secured to the back of the second sheet to finish the product, if desired. The backer may have holes or recesses for hanging the product, or it may include a fold-out leg to serve as an easel. In a preferred embodiment, a frame surrounds the perimeter of the front and rear sheets and snaps onto the backer sheet, thereby giving the assembly a finished look and, at the same time, holding the assembled layers together. The result is a heavy duty, attractive plaque having a raised, printed image. The plaque may be further personalized by attaching an engraved, brass tag or a label or by other known means.

The present invention thus provides a way to make the thin, printed, raised image heavier, sturdier, and more stable by mounting it onto a similarly-shaped layer, giving an effect similar to a much more expensive carved or cast and hand-painted product.

DESCRIPTION OF THE PREFERRED EMBODIMENT

Figure 1:
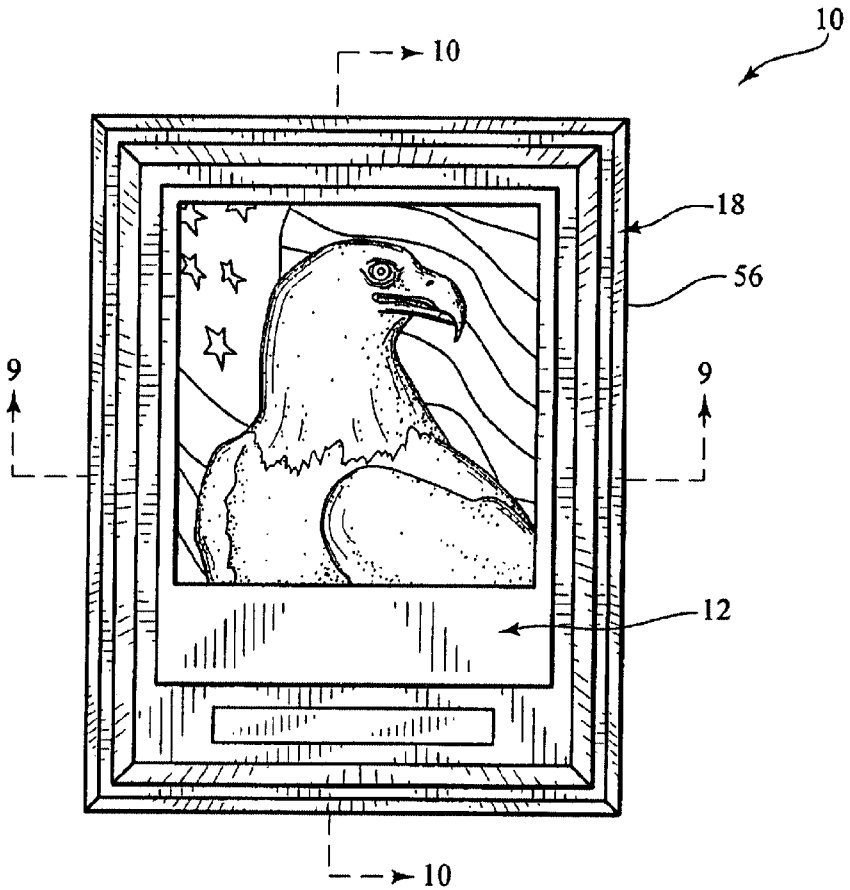
FIG. 1 is a front view of a raised image plaque made in accordance with the present invention.
Figure 2:
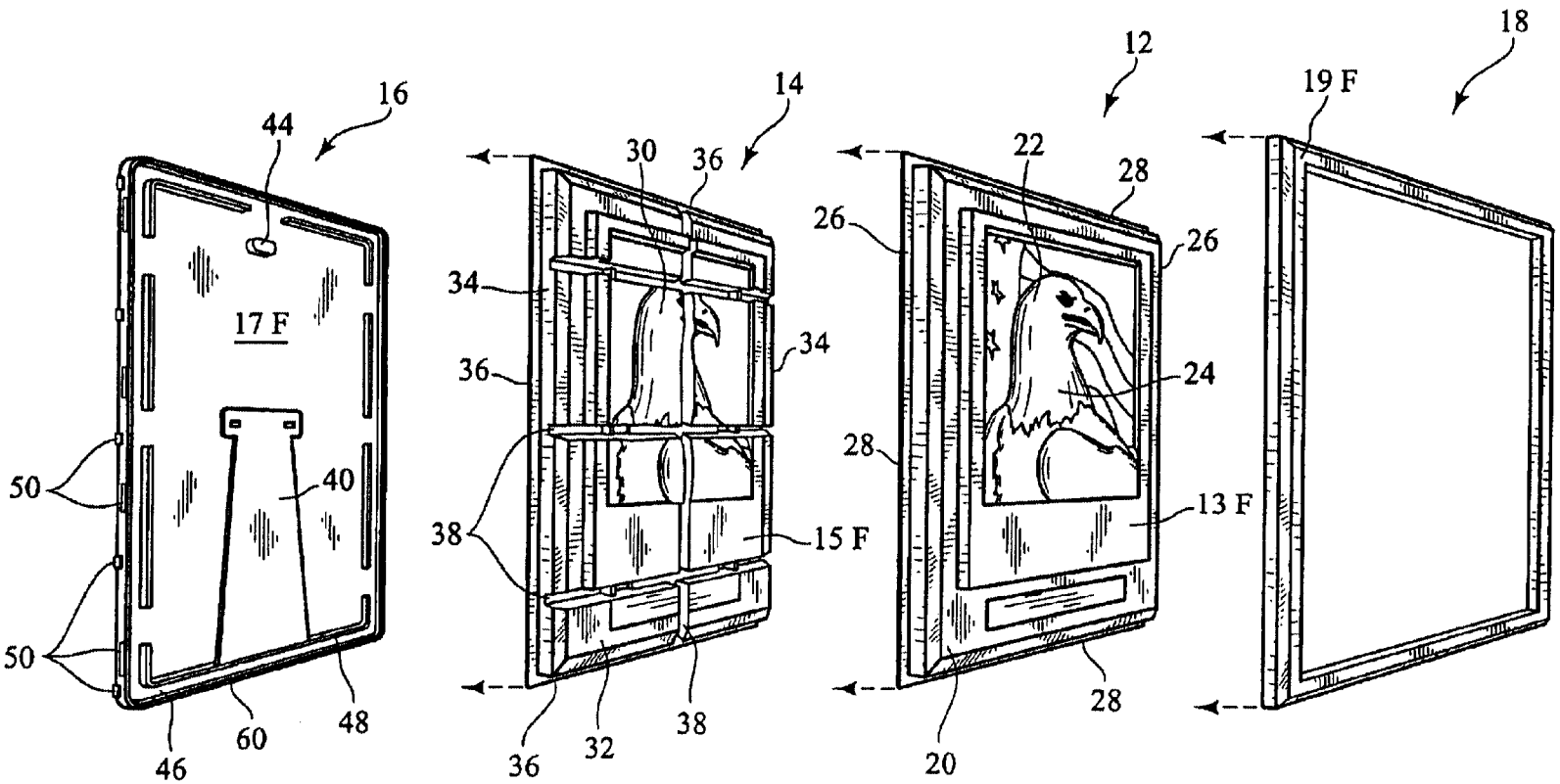
FIG. 2 is an exploded, perspective view of the plaque of FIG. 1.

FIGS. 1–10 show a raised, three-dimensional plaque 10 manufactured in accordance with the present invention. As shown in FIG. 2, this particular embodiment 10 comprises four pieces: a pre-printed, vacuum-formed cover sheet 12; a vacuum-formed, support sheet 14; a backer member 16; and a frame 18. In this embodiment, the cover sheet 12 and support sheet 14 are formed by vacuum forming, and the backer member 16 and frame 18 are injection molded. However, they may be made by other methods as well.

The printed, vacuum formed cover sheet 12 has an outside or front surface 13F and an inside or back surface 13B (See FIGS. 9 and 10), and is made of a relatively thin sheet of material on which a pattern or image has been printed. In this preferred embodiment, the material is 0.20-inch thick styrene. The printing preferably is done on a machine in which the printed sheet 12 is on a roll, which is fed through the printer and is then cut. It may be desired to print a marble design or another type of attractive design in the frame area 20 and to print an image to be formed as a relief image in the central area 22. The cut-out cover sheet 12 is then vacuum formed or formed by another known method to provide a formed, relief image 24 in the central area 22. The formed cover sheet includes contours corresponding to the printed image. The forming process also forms rearwardly-directed edges 26 around the periphery, which terminate in a flange or lip 28 which flares out approximately perpendicular to the edges 26. As discussed earlier, a raised frame 20 may also be formed on the cover sheet 12 between the rearwardly-directed edges 26 and the formed, raised image 24. The depth of the raised image portion (in this embodiment the eagle) is typically on the order of approximately one-eighth to one-half inch, and preferably about one-fourth of an inch, but it can be deeper if necessary. The depth of the cover sheet from the flange 28 to the most raised portion of the image is typically on the order of approximately one inch. Each portion of the cover sheet 12 may be printed differently, as desired, to produce an attractive product. For example, the central area 22 may be printed with a portrait or a landscape image (such as the eagle in this example), and the frame portion 20 may be printed with a marbelized design. While this preferred embodiment shows a rectangular-shaped cover sheet 12, it is understood that the plaque can be made in a variety of shapes, such as oval, hexagonal, circular, and so forth.

The cover sheet 12 has raised contours which form the relief image 24. For example, as shown in FIG. 2, the relief image of the eagle's wing is contoured to be at a higher elevation than his body, various feathers are raised to show texture, and the head is curved and raised at an elevation from the background. In addition, these raised contours of the wing, feathers, and head are in registration with the printed image of the wing, feathers, and head, so the resulting relief image appears to have been cast or carved and then painted.

A support layer 14, preferably made of thicker material, is formed in substantially the same shape as the printed cover sheet 12. (While this embodiment uses a single support layer, it is understood that there could be additional support layers.) The support layer 14 also defines a front surface 15F and a back surface 15B (See FIGS. 9 and 10). In this embodiment 10, the portion 30 of the support layer 14 which lies behind the raised image 24 has a shape that matches relatively closely with the shape of the raised image 24 of the printed cover sheet 12. The support layer 14 is typically made of a material that is too thick to be put on a roll and fed through a printer. In this case, the support layer is made of a styrene sheet, up to 0.80-inch thick, which is vacuum formed. While the support layer 14 is preferably made by vacuum forming a sheet, it may be made of a variety of materials formed by a variety of known methods, such as wood, metal, or plastic formed by carving, casting, pressing, and so forth.

Figure 9:
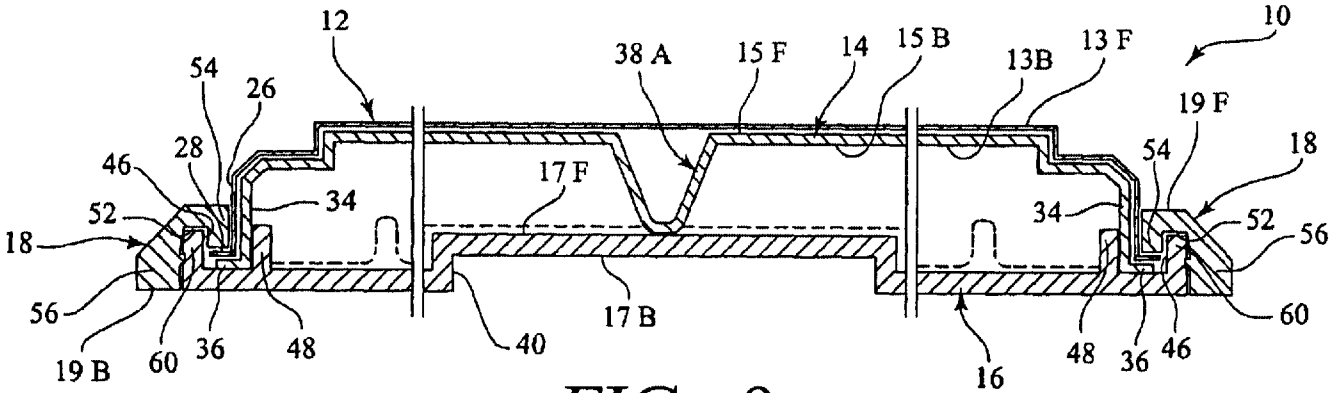
FIG. 9 is a sectional view taken along line 9—9 of FIG. 1.
Figure 10:
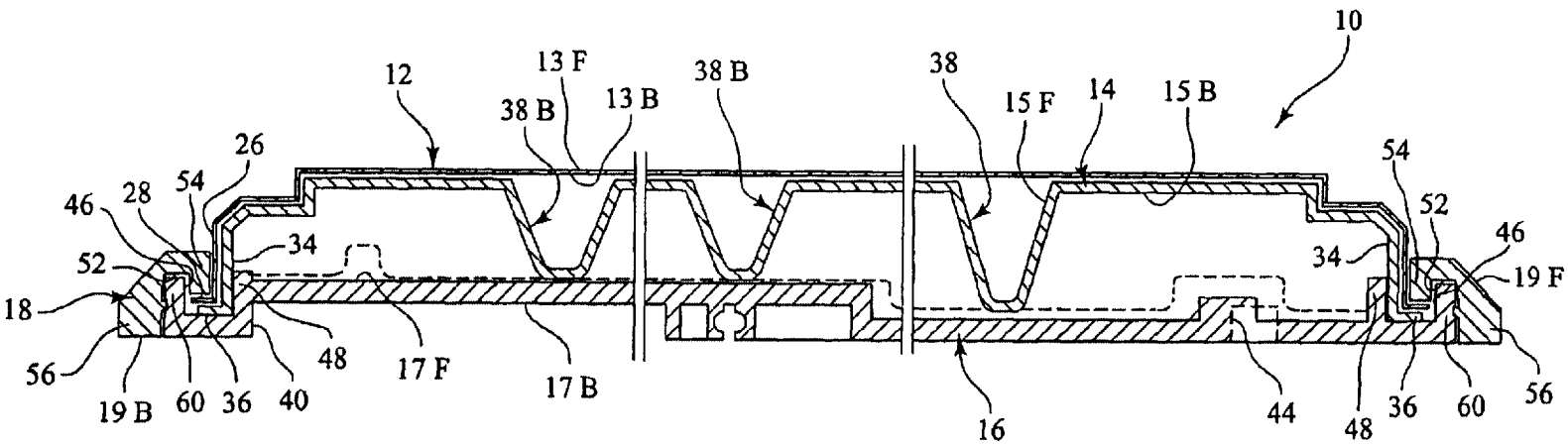
FIG. 10 is a sectional view taken along line 10—10 of FIG. 1.

As shown in FIG. 2, since the support layer 14 is formed in substantially the same shape as the printed cover sheet 12, it has a raised section 30 corresponding to the raised central area 22 of the printed cover sheet 12 (it may or may not include the shape of the relief image 24). It also has a raised frame 32 corresponding to the raised frame 20 of the printed cover sheet 12, as well as having rearwardly directed edges 34 and a flange 36 corresponding to the similar elements 26, 28 in the printed cover sheet 12. The support sheet 14 of this embodiment also has deep reinforcing ribs 38, which typically extend the full depth of the support sheet 14. (Note that some of the ribs, such as ribs 38A in FIG. 9 and 38B in FIG. 10 are not as deep as the regular ribs 38, so that they may rest upon, but not interfere with, the recessed area 40 for the easel 42). The ribs 38 of the support layer 14 do not correspond to any similar structure in the cover sheet 12 but are intended to provide strength and rigidity to the support layer 14, which, in turn, provides strength and rigidity to the cover sheet 12. The result is that the support layer 14, especially when covered by the printed sheet 12, gives the impression of being a solid piece because it does not "give" when pressed upon. The ribs 38 in this embodiment extend the full length and the full width of the support sheet 14. However, it is understood that the number and extent of the ribs may depend on specific geometry of the plaque as well as on the inherent rigidity of the material from which the support layer 14 is made. The intent is for the support layer 14, especially when covered by the printed sheet 12, to give the impression of being a solid piece in that it does not deflect or deflects only slightly when pressed upon.

While the front surface 15F of the support layer 14 substantially follows the contour of the cover sheet 12 and can be said to have a shape that is substantially complementary to the contour of the cover sheet, the front surface 15F of the support layer 14 does not follow the contour of the cover sheet 12 in the area of the reinforcing ribs 38. Instead, the reinforcing ribs 38 are formed by causing the front surface 15F of the support layer 14 to deviate rearwardly a substantial distance from the contour of the cover sheet 12.

A backing member 16 of relatively flat material is secured to the back of the support layer 14 to finish the back side of the plaque 10. This backing member 16 is preferably made from an injection molded plastic and is relatively heavy and rigid. In this case, it is substantially heavier and more rigid than the printed cover sheet 12 or the support layer 14. Referring to FIGS. 9 and 10, the backing member 16 defines a back surface 17B and a front surface 17F. The back surface 17B may have holes or recesses 44 for hanging the product, or it may include a fold-out leg 42 (see FIG. 7) in a recess 40 to serve as an easel. Or, its back surface 17B may simply be flat.

Figure 7:
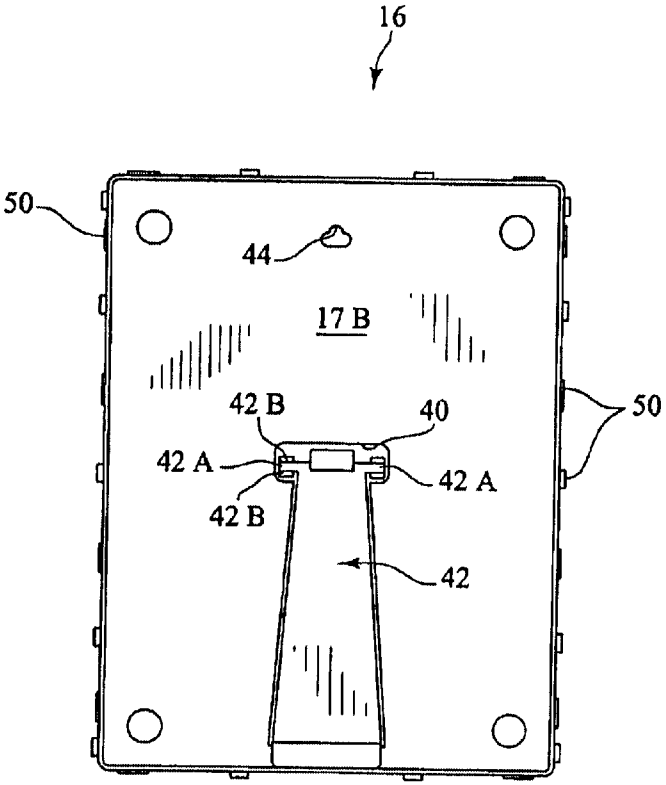
FIG. 7 is a rear view of the backer member of FIG. 6.
Figure 6:
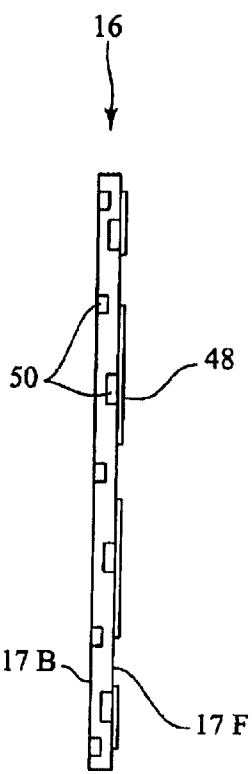
FIG. 6 is a side view of the backer member of FIG. 2.

The fold-out leg 42, shown in FIG. 7, has left and right projecting ears 42A, which snap into left and right receptacles 42B, formed on the back surface 17B of the backing member 16. Once the ears 42A have snapped into their respective receptacles 42B, they can pivot relative to the receptacles while being retained on the rear wall 17B of the backing member 16.

Along the front surface 17F of the backing panel 16 and offset inwardly a short distance from the panel's outermost edge, lies a U-shaped channel 46, defined by an inner wall 48 and an outer wall 60 and a trough therebetween. The U-shaped channel 46 receives the flange 36 of the support layer 14 and the flange 28 of the cover sheet 12. When the plaque is assembled, as shown in FIGS. 9 and 10, the flange 36 of the support layer 14 lies along the bottom of the U-shaped channel 46, and the rearwardly directed portions 34 of the support layer fit snugly just outside the inner wall 48 of the U-shaped channel 46. The snug fit between the edges 34 of the support layer 14 and the inner walls 48 of the U-shaped channel 46 allows practically no relative movement between these two pieces 14, 16 in the lateral direction. Similarly, there is a snug fit between the edges 34 of the support layer 14 and the edges 26 of the cover sheet 12, which prevents lateral movement of the cover sheet 12 relative to the support layer 14 and the backing member 16.

The frame 18 preferably snaps onto the backing member 16 in order to clamp the support layer 14 and the cover sheet 12 between the frame 18 and the backing member 16, which holds the assembly together. Projections along the periphery of the backing member 16 cooperate with indentations along the frame 18 to secure the frame 18 to the backing member 16, as will be explained in more detail shortly.

Figure 5:
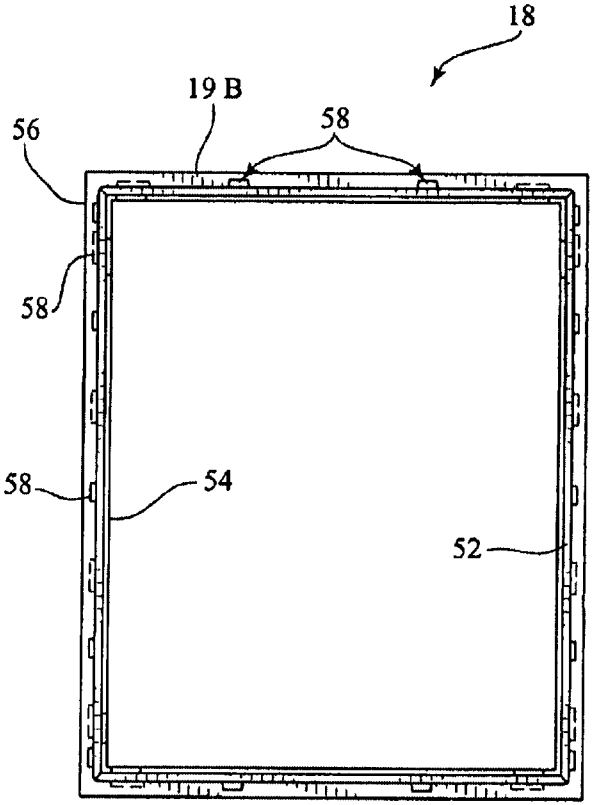
FIG. 5 is a rear view of the frame of FIG. 4.
Figure 4:
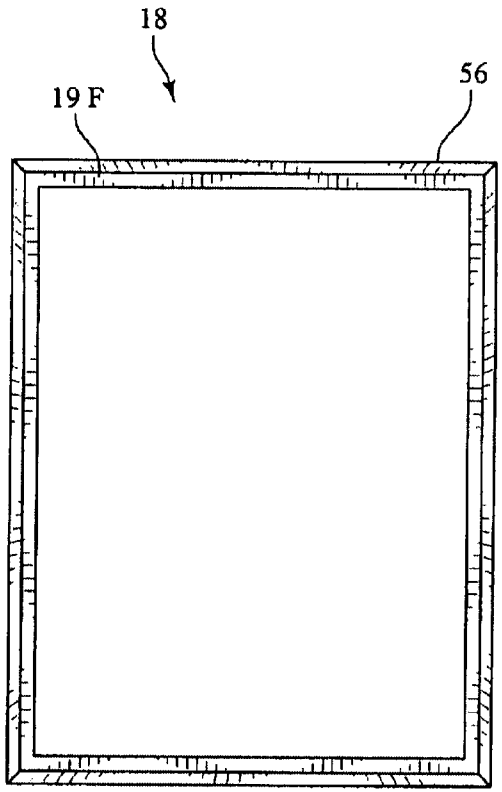
FIG. 4 is a front view of the frame of FIG. 3.
Figure 3:
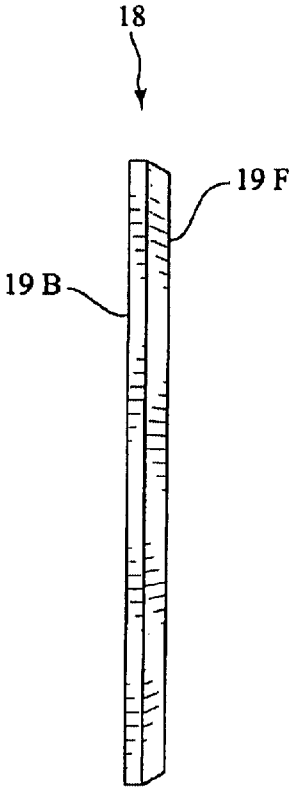
FIG. 3 is a side view of the frame shown in FIG. 2.
Figure 8:
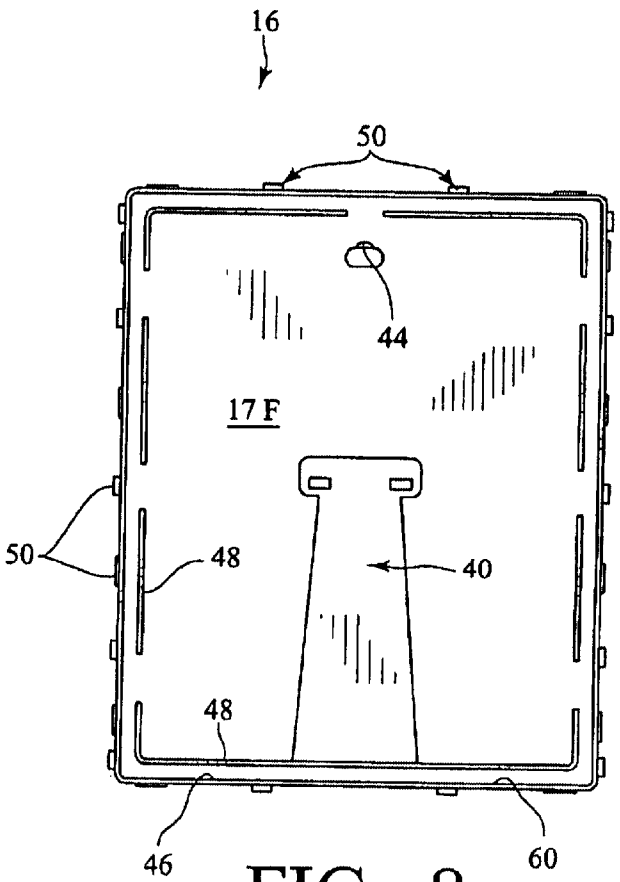
FIG. 8 is a front view of the backer member of FIG. 7.

The frame 18 preferably is made from injection molded plastic and, like the backing member 16, is also relatively heavy and rigid as compared to the printed sheet 12 and the support layer 14. As shown in FIGS. 3–5, 9, and 10, the frame 18 for this embodiment 10 has four interconnected sides and defines a front surface 19F and a back surface 19B. The back surface 19B defines a substantially U-shaped channel 52 (See FIGS. 9 and 10), which extends around the inner surface along all four sides of the frame 18. The U-shaped channel 52 is formed between an inside wall 54 and an outside wall 56. There are recesses 58 along the inside edge of the outside wall 56, as shown in FIG. 5. Some of the recesses 58 extend all the way to the rear edge of the frame, while others, shown in broken lines in FIG. 5, do not extend all the way to the rear edge of the frame. When the frame 18 is mated to the backing member 16 (as shown in FIGS. 9 and 10), the inside wall 54 of the frame 18 fits snugly inside the U-shaped channel 46 of the backing member 16, and the outside wall 60 of the backing member 16 in turn fits snugly inside the U-shaped channel 52 of the frame 18. The projections 50 on the backer panel 16 align with respective recesses 58 in the frame, sliding into the recesses 58 that extend all the way to the rear edge of the frame, and snapping into the recesses 58 that do not extend all the way to the rear edge of the frame 18. The snap fit retains the frame 18 on the backing member 16, with the inside wall 54 of the frame clamping down on the flanges 28, 36 of the printed cover sheet 12 and the support member 14 respectively, as explained below.

To assemble the panels, the inside surface 13B of the printed, formed cover sheet 12 is placed over the outside surface 15F of the support layer 14. The two layers then may be secured together, such as by gluing. The cover sheet 12 and support layer 14 are then placed onto the backing member 16, with the flange 28 of the printed cover sheet 12 lying on top of the flange 36 of the support shell 14, which, in turn, rests in the channel 46 of the backing member. The frame 18 is then placed over the assembly of the cover sheet 12, support layer 14, and the backing member 16, so that the projections 50 on the backing member 16 engage the recesses 58 of the frame 18, and the inside wall 54 of the frame 18 clamps down on the flanges 28, 36 of the printed shell 12 and the support shell 14, clamping the cover sheet 12 and the support layer 14 between the frame 18 and the backing member 16. The result is a heavy duty, attractive plaque having a raised image. The plaque may be further personalized by attaching an engraved, brass tag or a label or by other known means.

It will be obvious to those skilled in the art that modifications may be made to the embodiment described above without departing from the scope of the present invention. For example, while the parts of the preferred embodiment are primarily snapped together, they could be secured together by various known means, including adhesive, screws or other fasteners, or other known means. If an adhesive or other connection method is used, there may not be a need for the U-shaped channels and flanges taught in the preferred embodiment. Also, even using a snap-together arrangement as shown in the preferred embodiment, the support layer may not have a flange, since it is effectively clamped between the cover sheet and the backing member.

What is claimed is:

1. A decoration, comprising:

a cover sheet having a front face and a rear face, including a printed image on said front face, wherein said cover sheet is raised and is formed into a relief image having contours of varying depths, including contours in registration with the printed image, said cover sheet being made of thin gauge material which can be run through a printer before forming; and a raised contour support layer lying behind and supporting said cover sheet, said support layer having a front face including a complementary contour which substantially corresponds to the contour of the cover sheet, and wherein said front surface of said support layer includes contours which deviate rearwardly a substantial distance from the contour of said front face to define reinforcing ribs.

2. A decoration as recited in claim 1, and further comprising; a backing member lying in back of said support layer.

3. A decoration, comprising:

a cover sheet having a front face and a rear face, including a printed image on said front face, wherein said cover sheet is raised and is formed into a relief image having contours of varying depths, including contours in registration with the printed image, said cover sheet being made of thin gauge material which can be run through a printer before forming; and a raised contour support layer lying behind and supporting said cover sheet, said support layer having a front face including a contour which substantially corresponds to the contour of the cover sheet, and a backing member lying in back of said support layer, wherein said backing member has a perimeter and includes a first substantially U-shaped channel along said perimeter, said first U-shaped channel being defined by inner and outer walls and a trough therebetween.

4. A decoration as recited in claim 3, wherein said cover sheet and said support layer have perimeters, and wherein at least said cover sheet has a flange along its perimeter, wherein said flange rests in said trough of said first U-shaped channel.

5. A decoration as recited in claim 4, and further comprising:

a frame, and means for securing said frame to said backing member.

6. A decoration as recited in claim 5, wherein said securing means includes a substantially U-shaped channel along a perimeter of said frame, defining two walls and a trough therebetween, such that at least one of said walls of said frame rests in said trough of said backing member.

7. A decoration as recited in claim 6, and further comprising projections on at least one of the walls of one of said U-shaped channels and indentations on at least one of the walls of the other of said U-shaped channels, such that said projections mate with said indentations to secure said frame to said backing member.

8. A decoration, comprising:

a raised contour cover sheet defining a relief image and having a front surface and a back surface, and a thickness;

a raised contour support layer defining a front surface and a back surface and a plurality of ribs and having a thickness, wherein the front surface of said support layer substantially follows the contour of, lies adjacent to, and supports the back surface of said cover sheet, including the back surface of said relief image, while a portion of the front surface of said support layer deviates rearwardly a substantial distance from the contour of said cover sheet to form said ribs.

9. A decoration as recited in claim 8, wherein said support layer is made of a thicker material than said cover sheet.

10. A decoration as recited in claim 8, wherein the front face of said cover sheet includes a printed image in registration with said relief image, and said cover sheet is vacuum formed from a flat sheet.

11. A decoration as recited in claim 10, wherein said support layer also is vacuum formed from a flat sheet.

12. A decoration as recited in claim 8, and further comprising means for attaching the rear surface of said cover sheet to the front surface of said support layer.

13. A decoration as recited in claim 12, wherein said attachment means is an adhesive.

14. A decoration as recited in claim 12, wherein said attachment means includes first and second panels between which said cover sheet and said support layer are clamped.

15. A decoration as recited in claim 8, and further comprising;

a backing member defining a front face, a rear face, and a perimeter, wherein said backing member includes a first wall adjacent to its perimeter, and wherein said support layer and said cover sheet fit snugly over said wall.

16. A decoration, comprising:

a raised contour cover sheet defining a front surface and a back surface, and having a thickness;

a raised contour support layer defining a front surface and a back surface and a plurality of ribs and having a thickness, wherein the front surface of said support layer substantially follows the contour of, lies adjacent to, and supports the back surface of said cover sheet;

a backing member defining a front face, a rear face, and a perimeter, wherein said backing member includes a first wall adjacent to its perimeter, and wherein said support layer and said cover sheet fit snugly over said wall;

and further comprising a substantially U-shaped channel along said perimeter of said backing member, defined by said first wall and a parallel second wall, and a trough therebetween.

17. A decoration as recited in claim 16, wherein at least said cover sheet has a flange around its perimeter, and said flange rests in the trough of the U-shaped channel of said backing member.

18. A decoration as recited in claim 17, and further comprising;

a frame having a front surface and a rear surface, and a perimeter, and wherein said frame and said backing member have cooperating ridges and grooves for snapping said frame and backing member together.

19. A decoration as recited in claim 18, wherein said cover sheet and said support layer are made from vacuum formed styrene.

* * * * *